US008022285B2

(12) United States Patent
Zhang

(10) Patent No.: US 8,022,285 B2
(45) Date of Patent: Sep. 20, 2011

(54) AUTOMATIC GUITAR TUNING CASE

(75) Inventor: Zhenxiang Zhang, St. Catharines (CA)

(73) Assignee: Zhonxiang Zhang, St. Catharines, ON (CA)

( * ) Notice: Subject to any disclaimer, the term of this patent is extended or adjusted under 35 U.S.C. 154(b) by 537 days.

(21) Appl. No.: 12/036,205

(22) Filed: Feb. 22, 2008

(65) Prior Publication Data

US 2009/0211431 A1 Aug. 27, 2009

(51) Int. Cl.
*G10G 7/02* (2006.01)

(52) U.S. Cl. ..... 84/455

(58) Field of Classification Search ..... 84/454, 84/455, 458

See application file for complete search history.

(56) References Cited

U.S. PATENT DOCUMENTS

2009/0031879 A1* 2/2009 Everly ..... 84/454

* cited by examiner

*Primary Examiner* — Jeffrey Donels
*Assistant Examiner* — Andrew R Millikin

(57) ABSTRACT

An automatic guitar tuning case is a tuning system to automatically, synchronously, accurately and rapidly turn an acoustic guitar or electrical guitar with no requirement of modifying the guitar. It has six optical transducers to respectively detect and convert the vibration of associated six guitar strings to electric signals. A microcontroller unit compares the frequencies of these input signals to selected tones, and then controls six electric tuning wrenches for tuning the six guitar strings. The automatic tuning guitar system also consists of a control panel for a user to preset and select tuning pattern, operate and monitor the system. It only needs to take a few seconds to tune a guitar by this tuning device.

7 Claims, 11 Drawing Sheets

The Control Panel, Lid and Neck Base

5. Control panel Lid
6. Control panel
7. Neck base
15. LED array
16. Buttons of power, tune and rewind
17. LED Indicators of power, in-tune and alarm
18. Liquid crystal display
19. Preset buttons 5 Control panel Lid
9 Guitar strings
22 PCB board
24 Photo sensor
25 Transducer array unit 9. Strings
12. Guitar case lid
31. Strumming motor
32. Rack and screws
33. Picker Electric Tuning Wrench 41. Tuning peg adaptor
42. T-shaped shaft
43. Spring
44. Tuning motor Control Panel Lid and Neck Base 5. Control panel Lid
7. Neck base
9. Guitar strings
10. Guitar neck
24. Optical transducers
25. Transducer array unit

AUTOMATIC GUITAR TUNING CASE

FIELD OF THE INVENTION

This invention relates to an apparatus for automatic tuning stringed musical instruments.

BACKGROUND OF THE INVENTION

The following Patents describing automatic tuning devices use electromechanical devices to change or maintain pitch.

US Patent Application 20080006140, Adams, Jan. 10, 2008 "Device and Method for Automatic Tuning of a String Instrument in Particular a Guitar" discloses an automatic tuning devise for a guitar, by recording a tone and output of a corresponding digital signal to a comparator device for comparison of the digital signal with a digital signal corresponding to the desired tone, then adjust the tension of the string accordingly.

US Patent Application 20070240554, Hany, Oct. 18, 2007, "Musical tuning switcher" discloses that the invention is an attachable string tension control device for adjusting the pitch of each string of a musical instrument. Allowing an operator to switch instantly between a variety of pre-selected tunings.

US Patent Application 20070214935, Lyles, Sep. 20, 2007, "Stringed musical instrument using spring tension" discloses a stringed musical instrument employs springs to apply tension to corresponding musical strings. Each spring is chosen and configured for its ability to impart a string tension generally matched to the appropriate tension of the string at perfect tune.

US Patent Application 20060037459, Skinn, Feb. 23, 2006 "Apparatus and method for self-tuning stringed musical instruments with an accompanying vibrato mechanism" discloses that an automatic tuning guitar system for a stringed instrument is provided having a string adjustment assembly comprising a motor and gear assembly.

U.S. Pat. No. 6,278,047, Cumberland, Aug. 21, 2001 "Apparatus for tuning stringed instruments" discloses a microprocessor-controlled tuning apparatus for a stringed instrument, wherein the tension of a string is detected by a sensor, compared with a reference value, and readjusted until the detected value conforms with the reference value.

U.S. Pat. No. 5,886,270, Wynn, Mar. 23, 1999 "An electromechanical tuner for stringed instruments" discloses that the invention is an automatic tuning guitar system for a stringed instrument. An input sensor detects the tone of a plucked string and converts it to a square wave of the detected frequency, which is compared by the microprocessor and energizes the solenoid for engaging the gear mechanism for tightening or loosening the string to obtain the required frequency.

U.S. Pat. No. 5,859,378 Freeland, Jan. 12, 1999 "Musical instrument self-tuning system with cape mode" discloses a control system for automatically tuning a stringed musical instrument with a capo installed.

U.S. Pat. No. 5,824,929, Freeland, Oct. 20, 1998 "Musical instrument self-tuning system with calibration library" discloses a control system for automatically utilizing a library of calibration functions to tune a stringed musical instrument in a plurality of operating conditions without recalibration.

U.S. Pat. No. 6,437,226 Oudshoorn, et al. (2002)
U.S. Pat. No. 6,184,452 Long (2001)
U.S. Pat. No. 5,886,270 Wynn (1999)
U.S. Pat. No. 5,824,929 Freeland, et al. (1998)
U.S. Pat. No. 5,767,429 Milano, et al. (1998)
U.S. Pat. No. 5,528,970 Zacaroli (1996)

U.S. Pat. No. 5,343,793 Pattie (1994)
U.S. Pat. No. 5,095,797 Zacaroli (1992)
U.S. Pat. No. 4,958,550 Kugimoto (1990)
U.S. Pat. No. 4,803,908 Skinn, et al. (1989)
U.S. Pat. No. 4,584,923 Minnick (1986)
U.S. Pat. No. 4,228,715 Nourney (1980)
U.S. Pat. No. 4,088,052 Hedrick (1978)

These systems or devises are all need to be added on a musical instrument or modify the musical instrument and no one use optical pickup to tune a stringed musical instrument.

SUMMARY OF THE INVENTION

This invention is for automatic, accurate and swift tuning any kind of guitar. It can either work on acoustic guitar or electric guitar regardless of string gauge and material. It doesn't require modifying the guitar itself. This invention can also be changed to an apparatus to automatic tune another kind of stringed musical instruments such as basses, banjo, mandolin, violin or even piano.

Objects and Advantages

This invention can automatically tune a guitar according to a user's selected tuning and temperament. Comparatively, it's faster and more accurate than manually tuning. This invention does not need to modify the guitar itself. Any changing or adding a device on a conventional guitar body will result in the guitar sound fundamentally changed or sense of feeling missing, especially for an acoustic guitar.

To manually and accurately tune a guitar is not easy even with a tuner for help. It could take a few minutes, because changing one string's tension will affect other strings' tension on a guitar. So, need to tune string one by one and over again and again. However, the automatic guitar tuning case tunes all strings synchronically, and ended tuning only when all strings are in tune at the same time.

This invention can either tune electric guitar or acoustic guitar regardless of string gauge and material, because it uses optical transducers to detect the vibration of guitar strings. Unlike magnetic guitar pickup, the optical transducer only detects a dot section of a string, so it won't affect each other.

It's hard to twist some kind of guitar peg, such as classic guitar with nylon strings. It will go out of tune shortly after being tuned. It's easy and fast to tune as many times as you wish with this invention by just pressing a button.

Many guitarists like play open tunings and alternate tunings. In the automatic guitar tuning case, several regular open tunings and alternate tunings are preset in the program. To change tuning you just need to select one of preset buttons, and the guitar will be in tune as you wish.

Here are some most regular tuning patterns:

| | |
|---|---|
| Standard | E A D G B E |
| Open E | E B E G# B E |
| E Flat | Eb Ab Db Gb Bb Eb |
| Open D | D A D F# A D |
| Drop D | D A D G B E |
| DADGAD | D A A G A D |
| Double Drop D | D A D G B D |
| Open G | D G D G B D |
| Double Drop D | D A D G B D |

Also, users can store their favorite tuning patterns other than above preset tuning patterns in the tuning system.

This invention could be a tuning case to serve a specific guitar, or be a tool to serve a batch of the same model guitars or serve different model guitar by little adjustment.

It's easy to check if a guitar in tune or not with this system because all strings' pitch statues will be displayed on the LED array.

This tuning system is portable by a rechargeable battery.

If want to keep a guitar in no tension, the system can loose all strings in seconds. Next time, if want to play it again, just need to press a tune button and the guitar will be in tune in seconds.

The automatic guitar tuning case can be both a tuning tool and a carrying case.

This invention has a bonus of safety feature. If tuning by hand, usually, hands and eyes are closely exposure to the strings. Broken string might hurt hand or, in extreme case, injure the eye by accident. With this invention, such kind of incident would never happen because tuning guitar is always under cover.

DETAILED DESCRIPTION OF THE DRAWINGS

Figure 1:
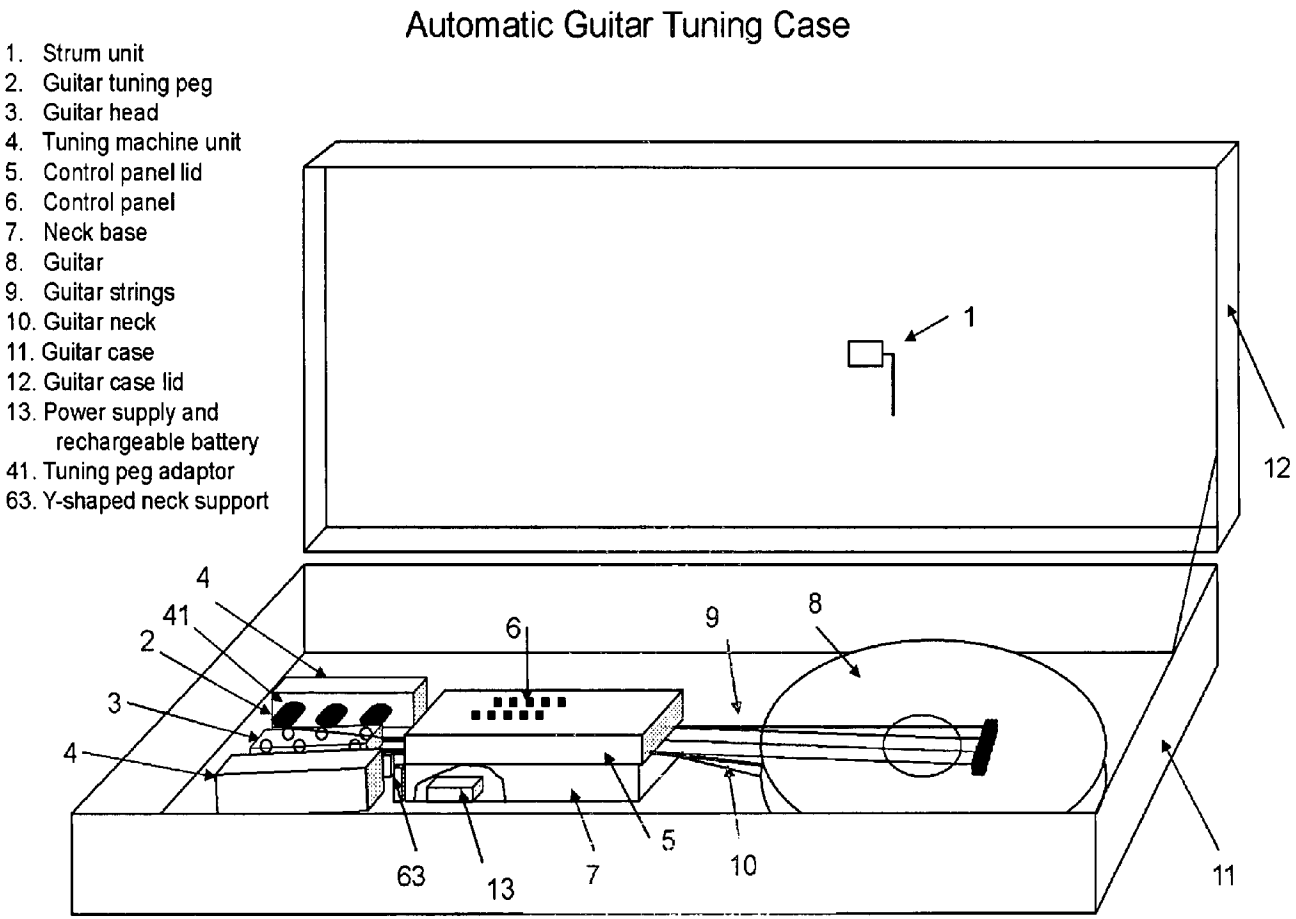
FIG. 1 shows the automatic guitar tuning case.

FIG. 1 shows the main units of the automatic guitar tuning case. In FIG. 1, two tuning machine units 4 set on two sides of a guitar head 3. The tuner units and microcontroller unit are all in the control panel lid 5. The control panel 6 is on the top of control panel lid 5. A power supply and rechargeable battery 13 set in the neck base 7. A strum unit 1 is mounted on the lid of an automatic guitar tuning case 12.

Figure 2:
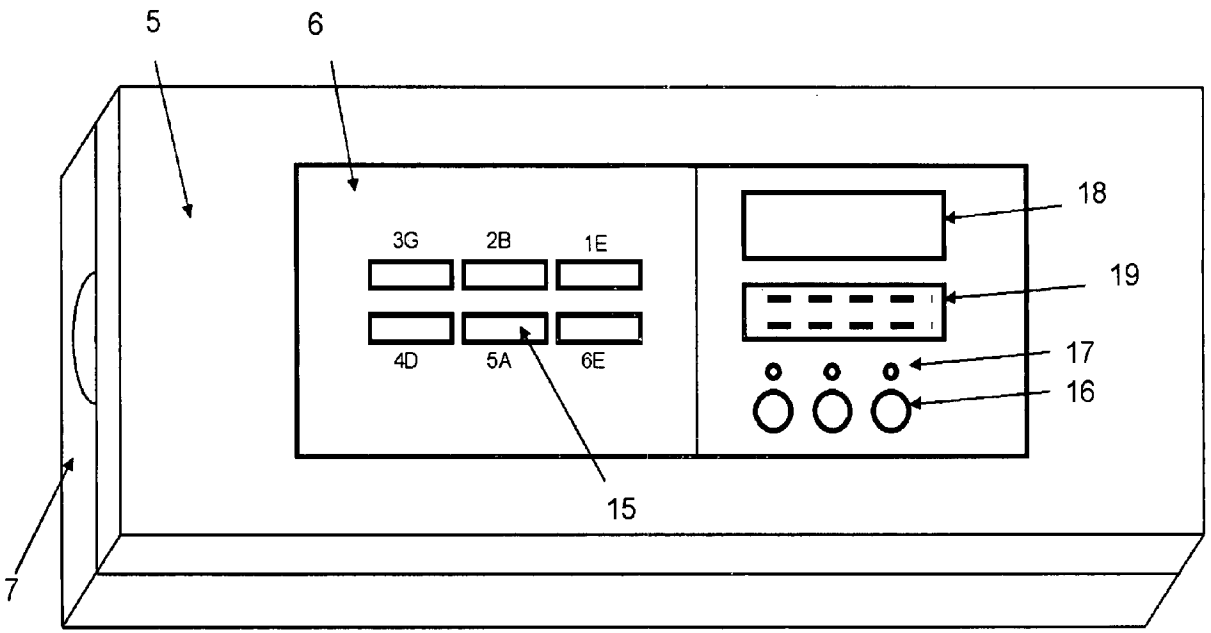
FIG. 2 is a top view of control panel and control panel lid with neck bass.

FIG. 2 shows a Control Panel 6 on a Control Panel Lid 5. On the control panel 6 there are LED Arrays 15 for showing all strings' pitch statues, an LCD (liquid crystal display) 18 for showing selected tuning and temperament. LED 17 are indicators of power-on, alarm and in-tune, some preset buttons 19, and some control buttons 16 of tune, rewind and on/off switch.

Figure 3:
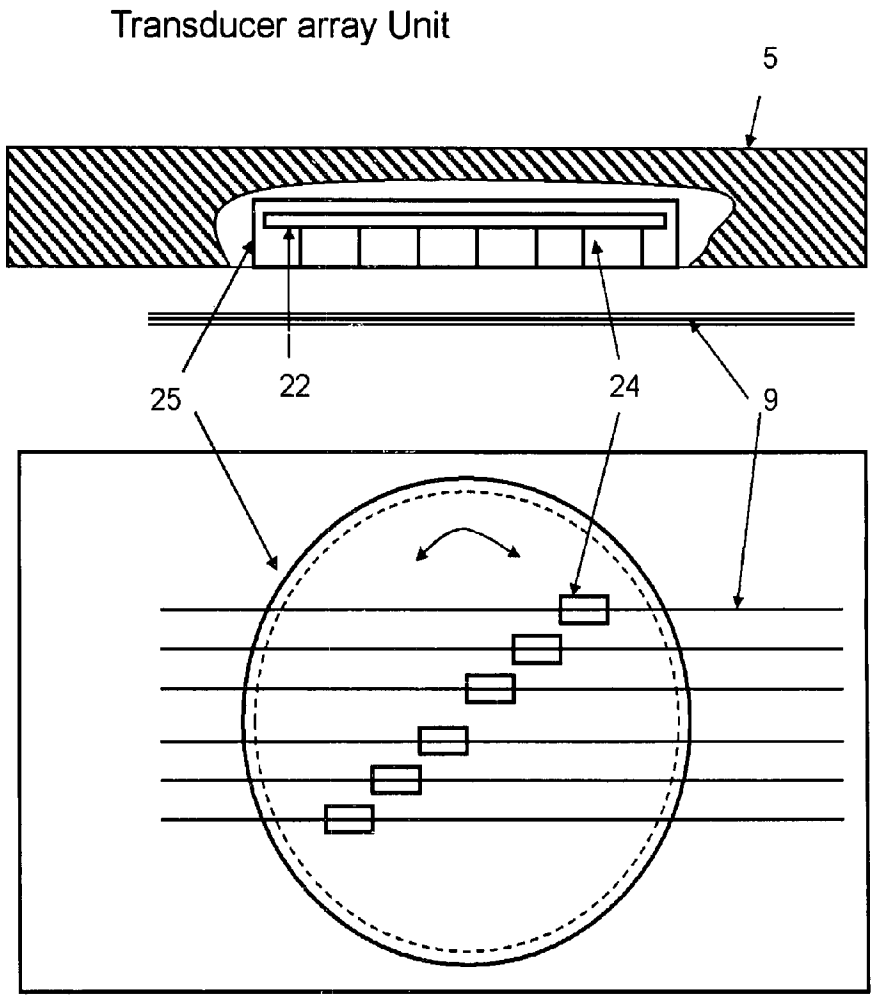
FIG. 3 is a perspective view of one kind of photo sensors riding on the guitar strings.

FIG. 3 shows an optical transducer array unit 25 which consists of six optical transducers 24 on a PCB 22. The optical transducer array unit 25 is installed on backside of the Control Penal 6. It could rotate a little bit for adjustment to match different wideness of guitar fingerboard and make the six photo sensors 24 exactly and respectively ride over the six strings 9.

Figure 4:
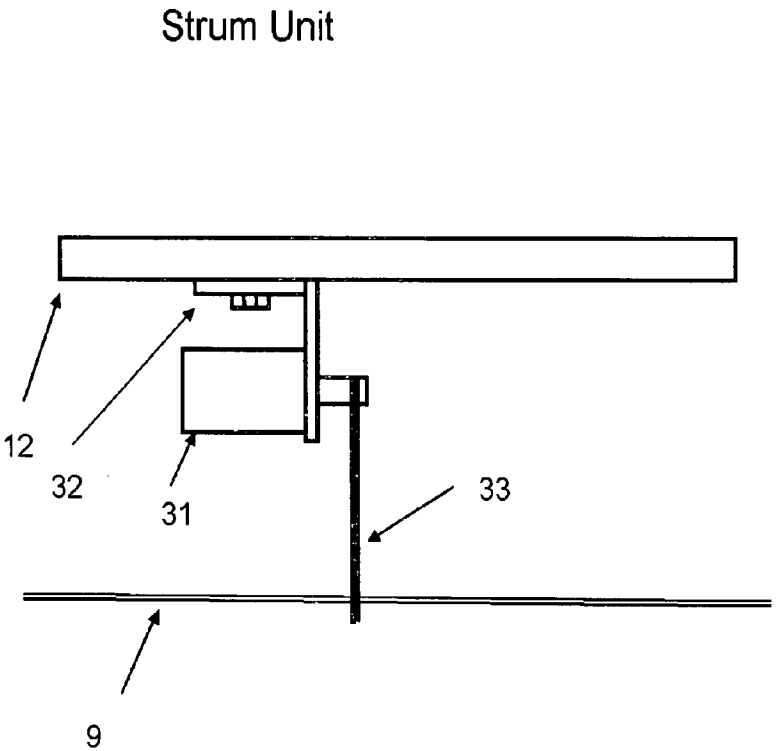
FIG. 4 is a front view of a strum unit.

FIG. 4 shows the structure of a strum device 1. A DC motor 31 is installed on a rack 32 which is mounted on the guitar case lid 12. The strum picker 33 is attached on the motor axle. So when the DC motor 31 tuning, the strum picker 33 will pluck the strings 9 at one direction.

Figure 5:
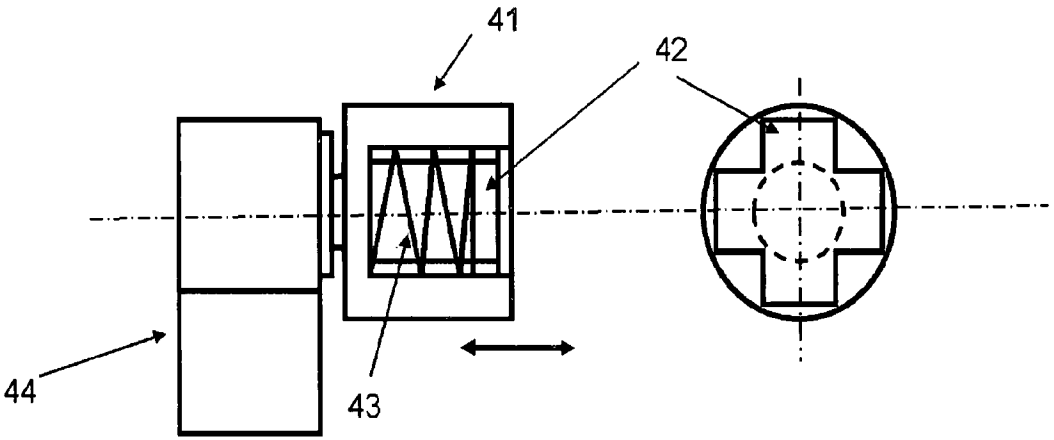
FIG. 5 is a perspective view of an electric tuning wrench.

FIG. 5 shows an electric tuning wrench. The tuning wrench is droved by a tuning motor 44. The tuning wrench mainly consists of a tuning peg adaptor 41, a T-shaped shaft 42 and a Spring 43.

Figure 6:
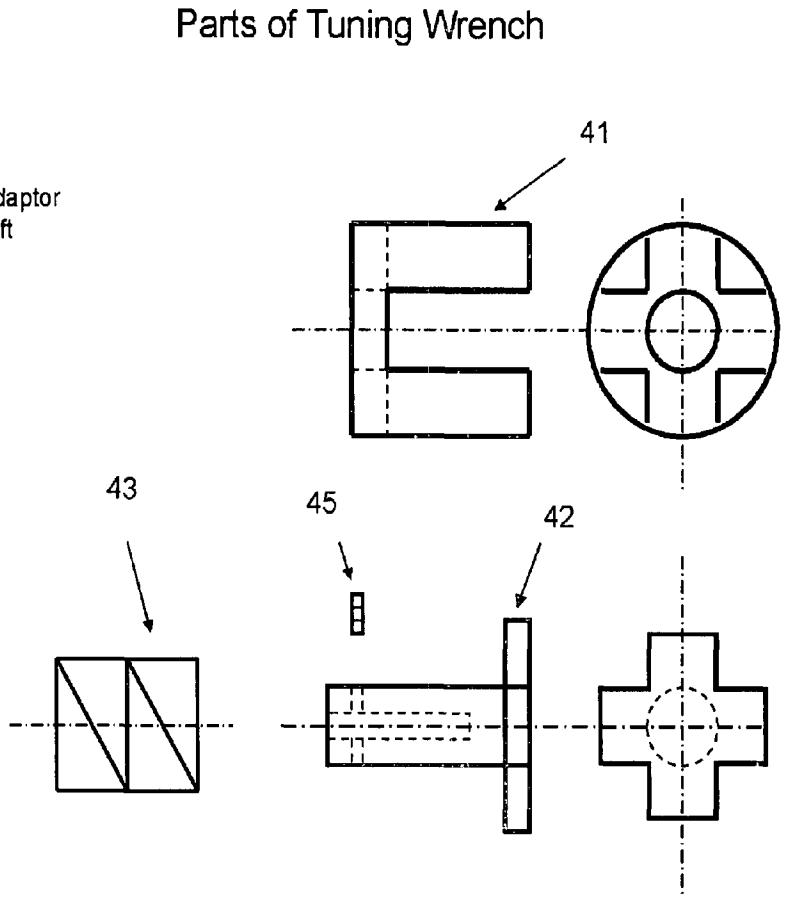
FIG. 6 is a perspective view of parts of tuning wrench.

FIG. 6 shows the parts of tuning wrench. On a tuning peg adaptor 41 there are two cross slots which can accommodate most kind of convention guitar peg. In the cent of the tuning peg adaptor 41 there is a hole-to let a T-shaped shaft 42 insert in. The tuning peg adaptor 41 can slide along the T-shaped shaft 42 and turning together. A spring 43 sits between them. T-shaped shaft 42 and tuning motor axis are coupled by a screw 45.

Figure 7:
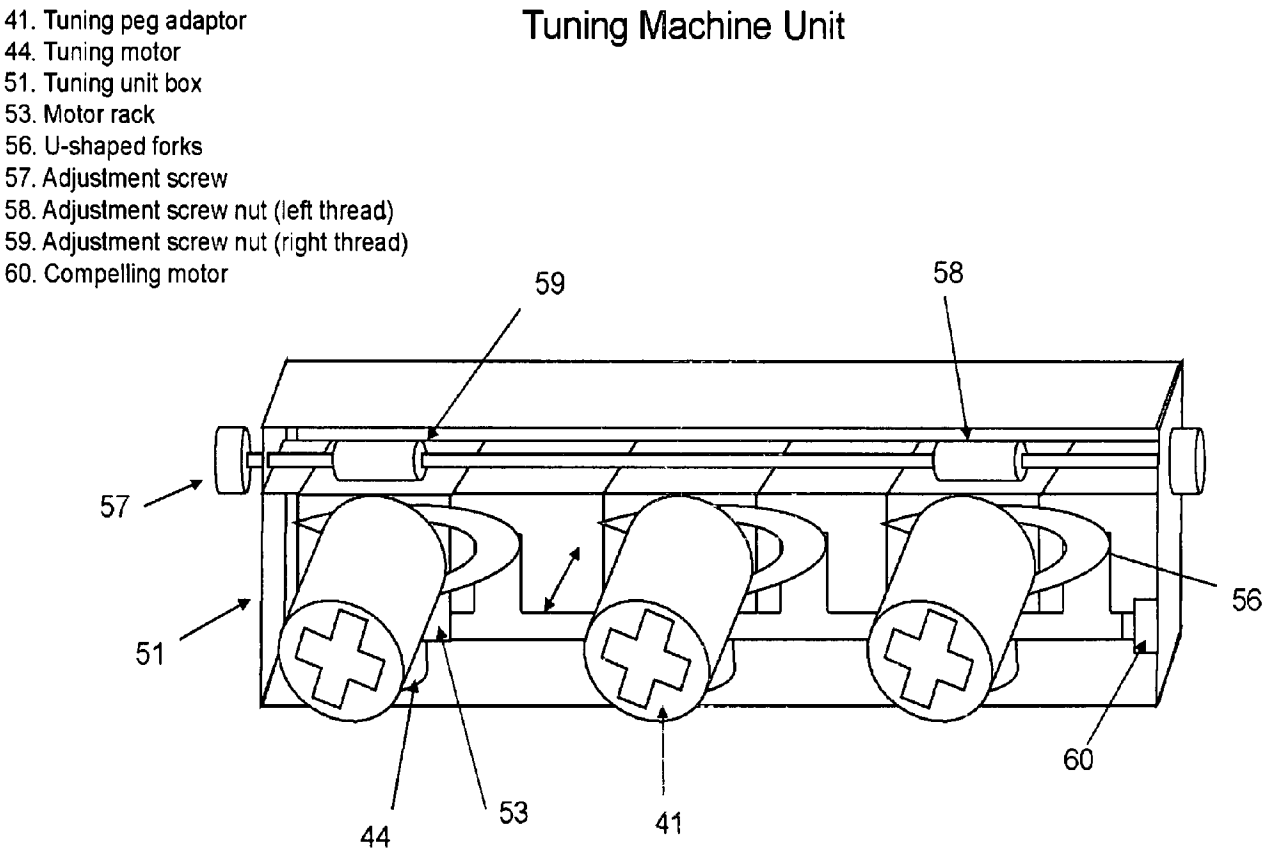
FIG. 7 is a front view of a tuning machine unit.

FIG. 7 shows the details of tuning machine unit. The tuning motors 44 are installed on motor racks 53. To match the interval of different guitar pegs, the interval of the tuning wrenches can be adjusted by turning the adjustment screw 57 because the middle tuning wrench is fixed and two sides of tuning wrenches are with opposite thread nut 58 (left thread) and nut 59 (right thread). So, tuning the adjustment screw 57 can change the interval of the electric tuning wrenches. When a compelling motor 60 drives an U-shaped forks 56, it pushes the tuning peg adaptors 41 forward to guitar pegs. If the peg doesn't match into a slot of the tuning peg adaptor 41, the tuning peg adaptor 41 will squeeze against the guitar peg. Meanwhile, the tuning motor 44 drives the tuning wrench until a slot of the tuning peg adaptor 41 matches the guitar peg and clutches the guitar peg. Then, the electric tuning wrench is able to drive a guitar peg for tightening or loosening the string. When the compelling motor 60 turns back, spring 43 pushes the tuning peg adaptor 41 back to the initial position.

Figure 8:
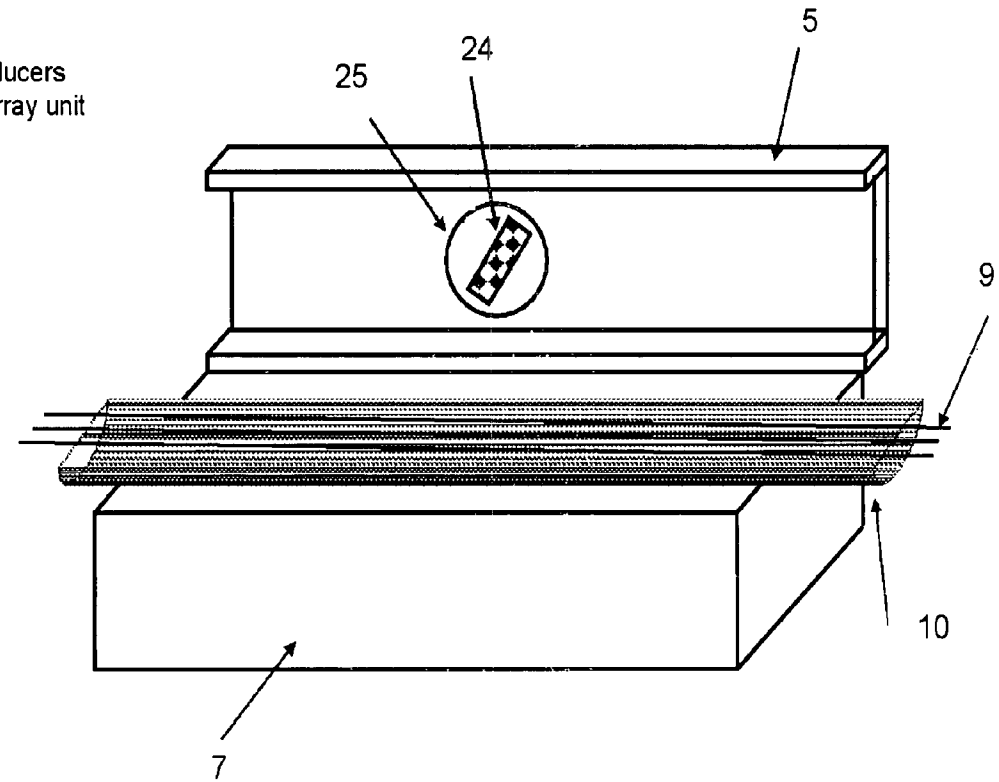
FIG. 8 shows an opened control penal lid with neck base.

FIG. 8 shows an opened control panel lid and neck base. The optical transducer array unit 25 is installed on the backside of control panel 6. The control panel lid 5 hinges with a neck base 7. If close the control panel lid 5, six transducers 24 will exactly and respectively ride over six guitar strings 9.

Figure 9:
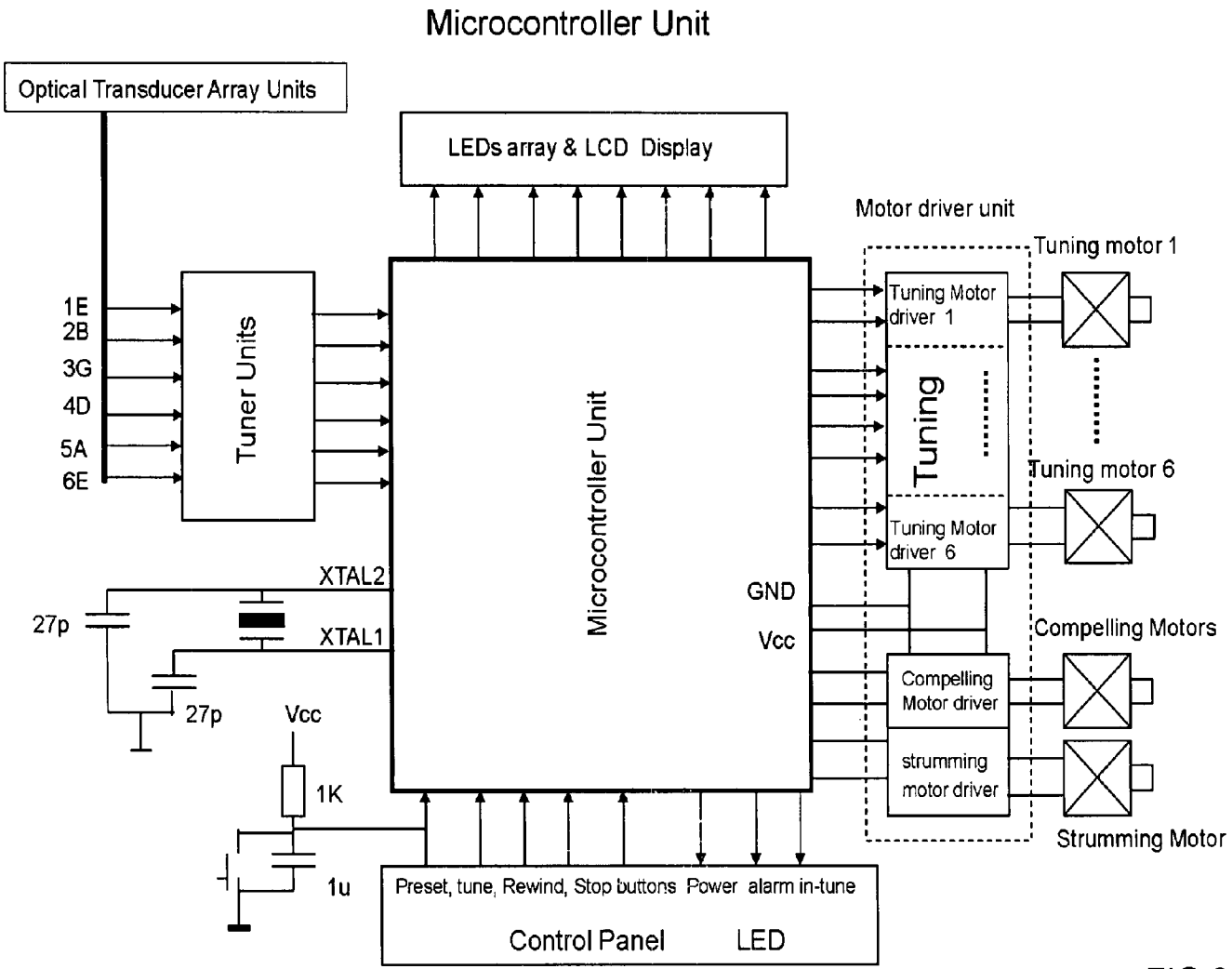
FIG. 9 is a schematics of the tuning guitar system.

FIG. 9 shows a block diagram of Processors. A microcontroller unit receives signals from tuner units and the control panel. It outputs control signals to drive tuning motors, compelling motors and strumming motor. Meanwhile, provides display signals to the control panel for displaying all strings' pitch status on LED array and selected tuning and temperament on LCD.

Figure 10:
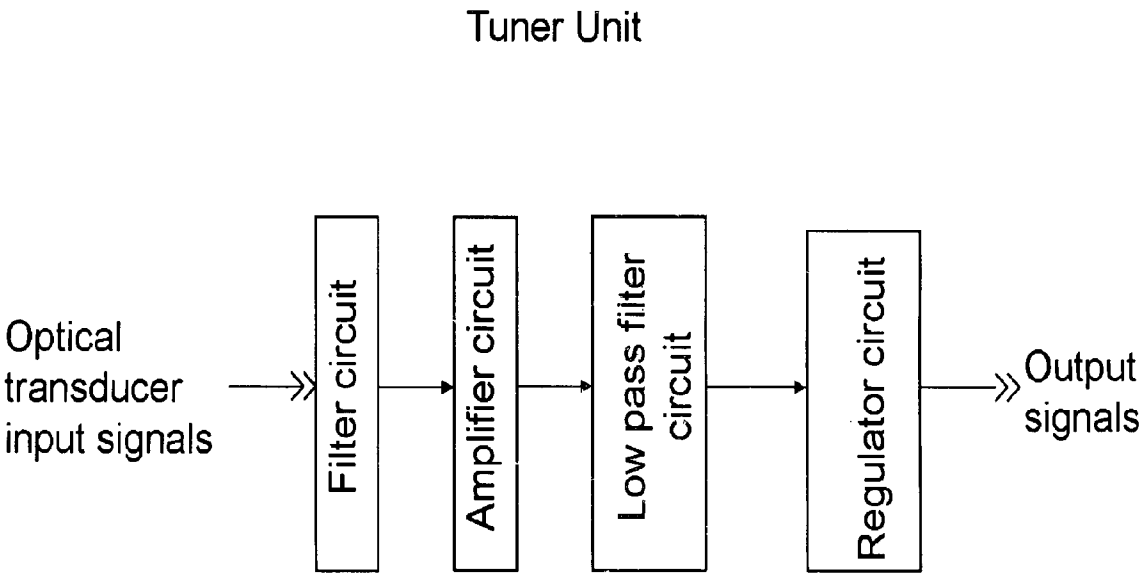
FIG. 10 is a block diagram of a tuner unit.

FIG. 10 shows a flow diagram of Tuner Unit. The signals from optical transducers pass through a Filter circuit, Amplifier circuit, Low Pass Filter, Regulator circuit and finally feed into the microcontroller unit.

Figure 11:
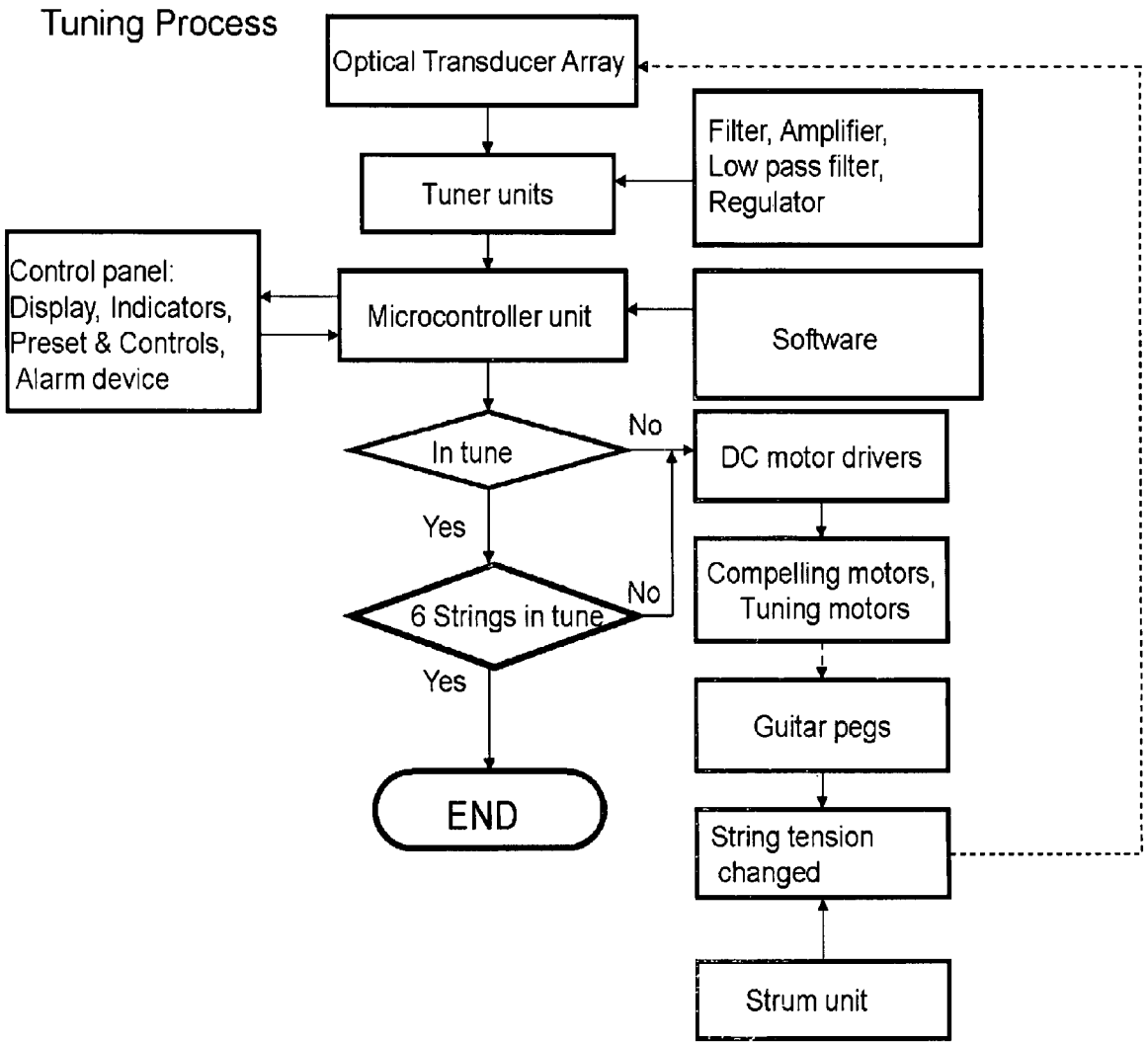
FIG. 11 is a block diagram of a tuning process.

FIG. 11 shows the flow diagram of whole tuning process. The automatic guitar tuning case is a closed-loop control system. A strum unit plucks the six strings on a guitar and six optical transducers respectively convert these vibrating strings to electric signals. These electric signals will input to six tuner units to be regulated, then, feed into a microcontroller unit which will analyze and counter the frequency of these signals and compare to selected tones. The result of the comparison determines the six electric tuning wrenches how to tune the six guitar strings.

Alternate Embodiment

If taking off the control panel lid 5 from the neck bass 7 and install it on the inside of guitar case lid 12, then, only need to close the guitar case lid 12 to automatically tune a guitar.

List No. of components, parts and units:

1. Strum unit
2. Guitar tuning pegs
3. Guitar head
4. Tuning machine unit
5. Control penal lid
6. Control panel
7. Neck base
8. Guitar
9. Guitar strings
10. Guitar neck
11. Guitar case
12. Guitar case lid

13. Power supply and rechargeable battery
15. LED Array
16. Buttons of preset, tune and rewind
17. LED Indicator of power-on, in-tune and alarm
18. LCD (Liquid Crystal Display)
19. Preset buttons
22. PCB board
24. Transducers
25. Transducer array unit
31. Strumming motor
32. Rack and screws
33. Picker
41. Tuning peg adaptor
42. T-shaped shaft
43. Spring
44. Tuning motor
45. Screw
51. Tuning unit box
53. Motor rack
56. U-shaped fork
57. Adjustment screw
58. Screw nut (left thread)
59. Screw nut (right thread)
60. Compelling motor
63. Y-shaped neck support

The invention claimed is:

1. An automatic guitar tuning case comprising (1) an automatic strum device for plucking strings to mechanically vibrate all of the strings on a guitar, (2) six optical transducers respectively riding over six strings on a guitar to independently convert mechanically vibration of the guitar strings to electric signals, (3) six tuner units for regulating said electric signals, (4) a microcontroller for executing preset tunings, display, data process and control of the tuning system, (5) a tuning processor software which further comprises a signal wave analyzer, signal frequency counter, frequency comparator and a tone database, (6) a microcontroller software which comprises a tuning program, a loosening string program, a preset program and a display program, (7) tuning machine units which further consist of six electric tuning wrenches, (8) a control panel which further comprises an LCD for showing selected tuning and temperament, LED array for indicating all strings' pitch status, LEDs as indicators of power-on, in-tone and alarm, preset buttons for selecting tunings, and control buttons of tune, rewind and on/off switch, (9) a power supply and a rechargeable battery for supplying energy to said tuning system,

(10) a neck base or neck support which holds on a guitar neck to hold it in immovable proper position,

(11) a strap pin support which holds on a guitar body to it in immovable proper position, and

(12) a case for housing a guitar and a said tuning system which includes all above components, parts, means, devices and software.

2. The automatic guitar tuning case of claim 1, wherein said transducers can either be optical or piezoelectric pickups, which must be able to independently detect and convert the mechanical vibration of their associated guitar strings to electric signals without affecting each other.

3. The automatic guitar tuning case of claim 1, wherein said tuning program in microcontroller performs collecting the result of compared frequency from said tuner unit, outputting control signals to said electric tuning wrenches, and ending said tuning program when all six guitar strings are all in tune at the same time, or stopping said tuning program when an error occurred.

4. The automatic guitar tuning case of claim 1, wherein said electric tuning wrench further comprises a tuning motor and a tuning wrench which is attached on the spinning axle of said tuning motor.

5. The automatic guitar tuning case of claim 4, wherein said tuning wrench further comprises a tuning peg adaptor in which there is a center hole and two slots, a T-shaped shaft which inserts into said center hole, a spring setting between said tuning peg adaptor and said T-shaped shaft.

6. The automatic guitar tuning case of claim 1, wherein said electric tuning wrenches are installed on individual motor racks.

7. The automatic guitar tuning case of claim 6, wherein said motor racks are movable and adjustable installed in a housing box for adjusting the intervals of said electric tuning wrenches to match different intervals of guitar pegs.

* * * * *